US005703318A

United States Patent [19]

Franchino et al.

[11] Patent Number: 5,703,318

[45] Date of Patent: Dec. 30, 1997

[54] ARTILLERY GUN MOUNT

[75] Inventors: Anthony R. Franchino, Whitehouse Station, N.J.; Steven McDonald, Reeders, Pa.

[73] Assignee: The United States of America as represented by the Secretary of the Army, Washington, D.C.

[21] Appl. No.: 794,792

[22] Filed: Feb. 4, 1997

Related U.S. Application Data

[60] Provisional application No. 60/004,067, Sep. 20, 1995.

Related U.S. Application Data

[63] Continuation-in-part of Ser. No. 714,717, Sep. 16, 1996, abandoned.

[51] Int. Cl.[6] ..... F41A 13/04; F41A 25/02; F41A 27/14; F41A 5/16

[52] U.S. Cl. ..... 89/37.07; 89/43.01; 89/14.1; 89/36.08; 89/36.02

[58] Field of Search ..... 89/43.01, 37.07, 89/37.14, 14.1, 36.08, 36.02

[56] References Cited

U.S. PATENT DOCUMENTS

| | | | |
|---|---|---|---|
| 472,244 | 4/1892 | Acland et al. | 89/37.07 |
| 838,694 | 12/1906 | Deport | 89/43.01 |
| 2,125,892 | 8/1938 | Dabrasky | 89/37.07 |
| 2,966,829 | 1/1961 | Tannenbaum | 89/43.01 |
| 5,105,716 | 4/1992 | Hahn et al. | 89/36.08 |

FOREIGN PATENT DOCUMENTS

| | | | |
|---|---|---|---|
| 35412 | 1/1912 | United Kingdom | 89/43.01 |

*Primary Examiner*—Stephen M. Johnson
*Attorney, Agent, or Firm*—Michael C. Sachs

[57] ABSTRACT

A gun mount system is described which is capable of firing long range projectiles under rapid firing conditions with gun tube and recoil system replaceability under field conditions.

13 Claims, 9 Drawing Sheets

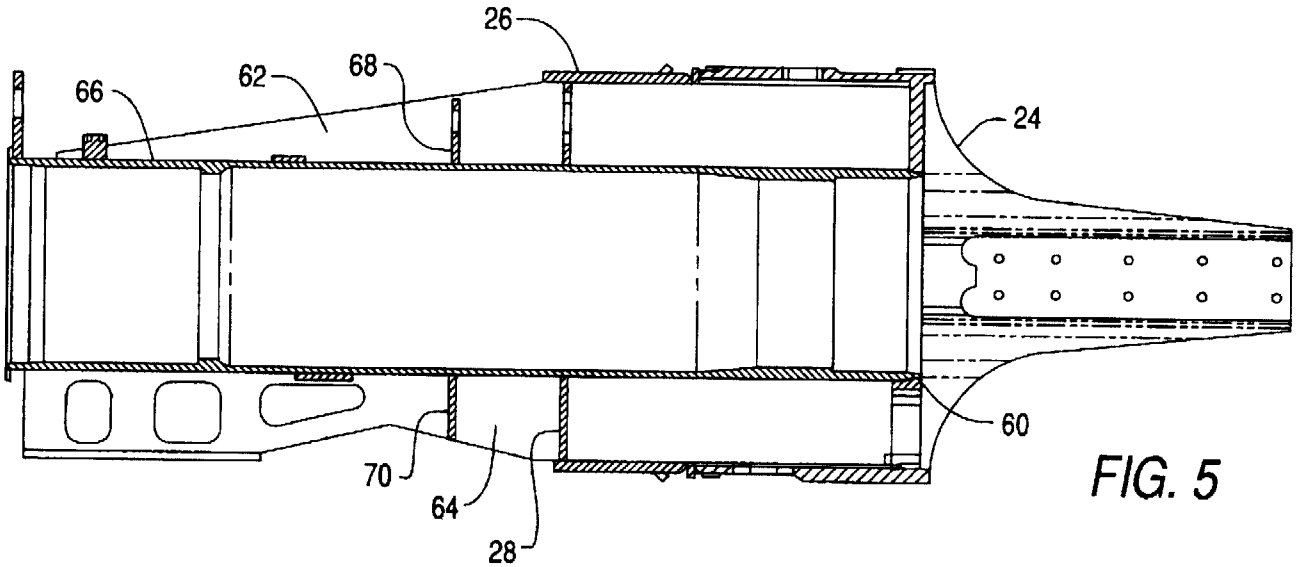
FIG. 5
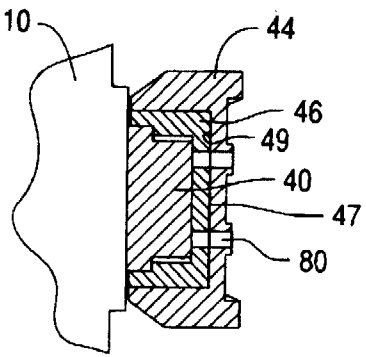
FIG. 12
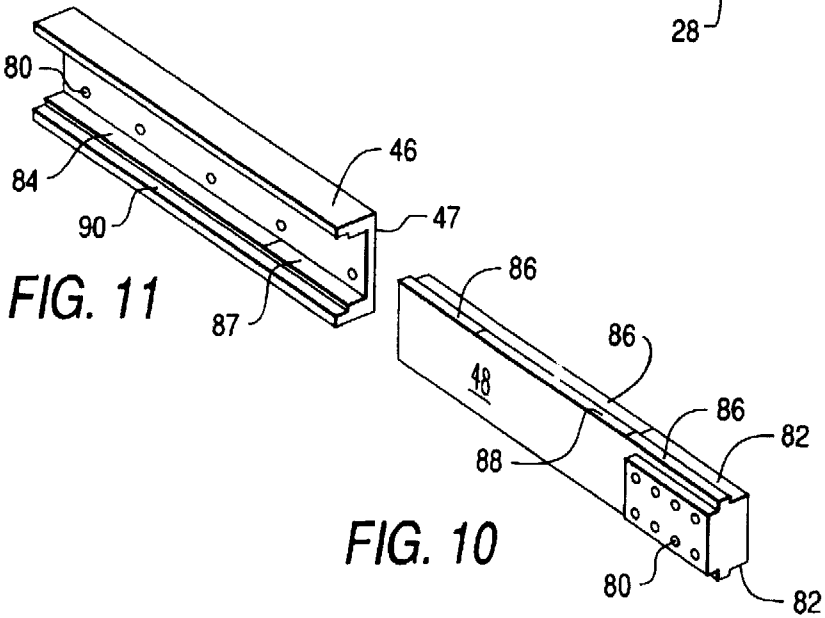
FIG. 10
FIG. 11

ARTILLERY GUN MOUNT

This application is a continuation-in-part of application Ser. No. 08/714,717, filed on Sep. 16, 1996, and now abandoned; which in turn is a continuation-in-part of provisional application Ser. No. 60/004,067, filed on Sep. 20, 1995, and now abandoned.

GOVERNMENT INTEREST

The invention described herein may be manufactured, used and licensed by or for the United States Government.

BACKGROUND OF THE INVENTION

The trend in modern artillery is toward cannons which have long range, rapid fire capability, and enhanced ballistic protection utilizing lightweight armor systems. In order to accomplish these goals longer gun barrels have been introduced which impart higher muzzle velocities to the projectile. The longer gun barrels and higher projectile velocity have necessitated the use of cannons and recoil mechanisms which need to be cooled to maintain acceptable temperature during rapid fire missions. It is also desirable that these long range, rapid fire weapons be more readily repaired in the field rather than having to be shipped to a distant depot for maintenance. Rapid fire frequently causes gun tube "burn-out" to occur more frequently requiring tube replacement at shorter intervals in the field. Since rapid fire artillery also places great strain on the recoil system, there has been a need to improve the field replaceability of the recoil system. Prior 155 mm artillery gun mounts failed to satisfy all of the aforementioned requirements.

SUMMARY OF THE INVENTION

The present invention relates to a 155 mm gun mount system which is capable of firing a projectile long range under rapid fire conditions, having field replaceability capability of both gun tube and recoil systems.

An object of the present invention is to provide a gun mount system having rails and ways located entirely behind mount trunnions.

Another object of the present invention is to use rails and ways which locates the breech near the trunnions at the start of firing, when rifling torque is at its peak, thereby providing a short load path to the gun mount system and reducing deflections in the mount structure.

Another object of the present invention is to provide an improved gun mount system which utilizes modular, integral liquid cooled recoil mechanisms.

Another object of the present invention is to provide a gun mount system having a tailorable hinged or removable ballistic shield cover.

Another object of the present invention is to provide a 155 mm gun mount system which is simpler to fabricate and assemble.

A further object of the present invention is to provide a 155 mm gun mount system which is easier to maintain under battlefield conditions.

For a better understanding of the present invention, together with other and further objects thereof, reference is made to the following descriptions taken in connection with the accompanying drawings.

BRIEF DESCRIPTION OF THE DRAWINGS

FIG. 5 is a longitudinal diametrical cross-sectional view of the cradle assembly taken along line 5—5 of FIG. 3.

FIG. 10 is an isometric view of one of two breech rails used to support and reciprocating gun and breech assembly.

FIG. 11 is an isometric view of one of two cradle way bearings for supporting the rail of FIG. 10.

FIG. 12 is a partial cross-sectional view of the rail and way taken along line 12—12 of FIG. 2.

DETAILED DESCRIPTION OF THE PREFERRED EMBODIMENTS

Figure 1:
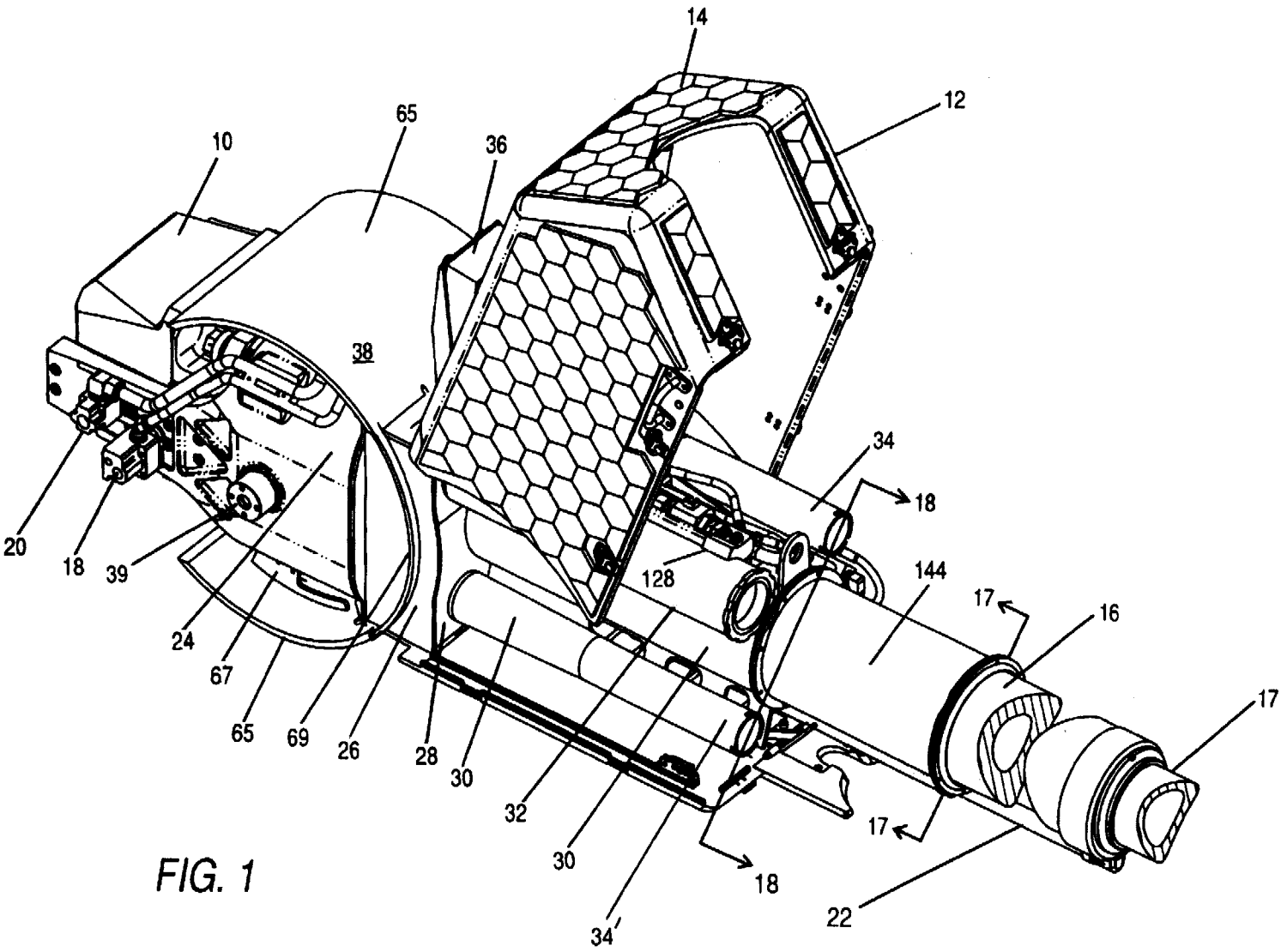
FIG. 1 is an isometric view of the gun mount and cannon assembly showing the ballistic shield in a fully open position. The breech is shown in simplified form in its normal firing position.

Referring now to FIG. 1, breech assembly 10 is shown in its forward in battery firing position. A molded composite ballistic hinged shield cover 12 is shown in an open position. Shield cover 12 has applique tiles 14 operatively connected thereto. A liquid cooled gun tube assembly 16 and recoil modules 32 are fluidly connected to supply coolant manifold 18 and a return manifold 20. Return coolant from gun tube assembly 16 is routed from telescoping tube assembly 22 via lines, to be discussed in detail hereinafter, back to manifold 20. The gun mount main support structure comprises a cradle casting 24 which is welded to a box-shaped adapter weldment 26, and, in turn, to a front bulk head member 28. The front bulk head member 28 is welded to and supports a gusseted tube assembly 30 and a pair of liquid cooled recoil modules 32 and 32' and a pair of recuperator modules 34 and 34'. The adapter weldment 26 also supports a radar velocimeter bracket 36. A rotor shield assembly 38 comprised of a formed radius titanium armor plates 65 and 65' are fixedly attached to cradle casting 24 with brackets 67, 67' to cradle casting 24. Rotor shield extensions 69 are welded to the side plates of adapter weldment 26. The cradle casting contains trunnions 39 and 41, the latter being shown in FIG. 2, which permit rotary elevation of the gun mount about the trunnion axes 39 and 41.

Figure 2:
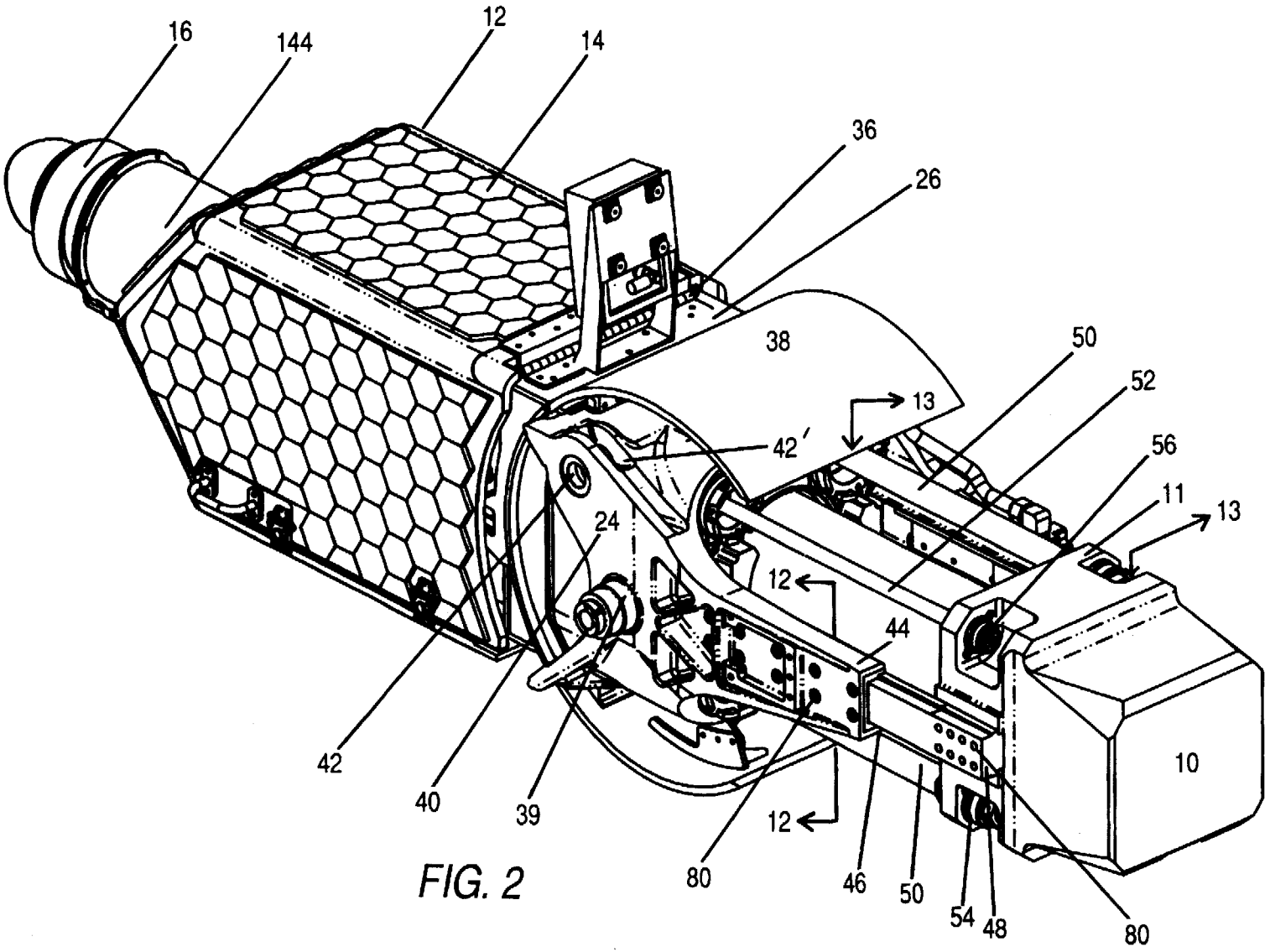
FIG. 2 is an isometric rear angled opposite side view of FIG. 1 showing the gun mount and cannon assembly with the gun and breech in a fully-recoiled position and the ballistic shield in a closed position.

Referring now to FIG. 2, the gun mount shows the breech block 10 in its fully recoiled position. The cradle casting 24 supports an elevation lug 40 with bores therein which contain a pair of bushings 42 and 42' therein. Cradle casting 24 possesses on both sides of the breech ways

44, 44' for fixedly holding therein way bearings 46, 46' shown in greater detail hereinafter. A pair of breech guide rails 48, 48' are fixedly attached to the breech assembly 10 and slideably permits the breech assembly to translate without linearly whipping motion during gun recoil and counter recoil motions. Recoil rods 50, 50' and recuperator rods 52, 52' are connected to the breech assembly 10 by universal couplers 54 and 56 which will be discussed in more detail hereinafter.

Figure 3:
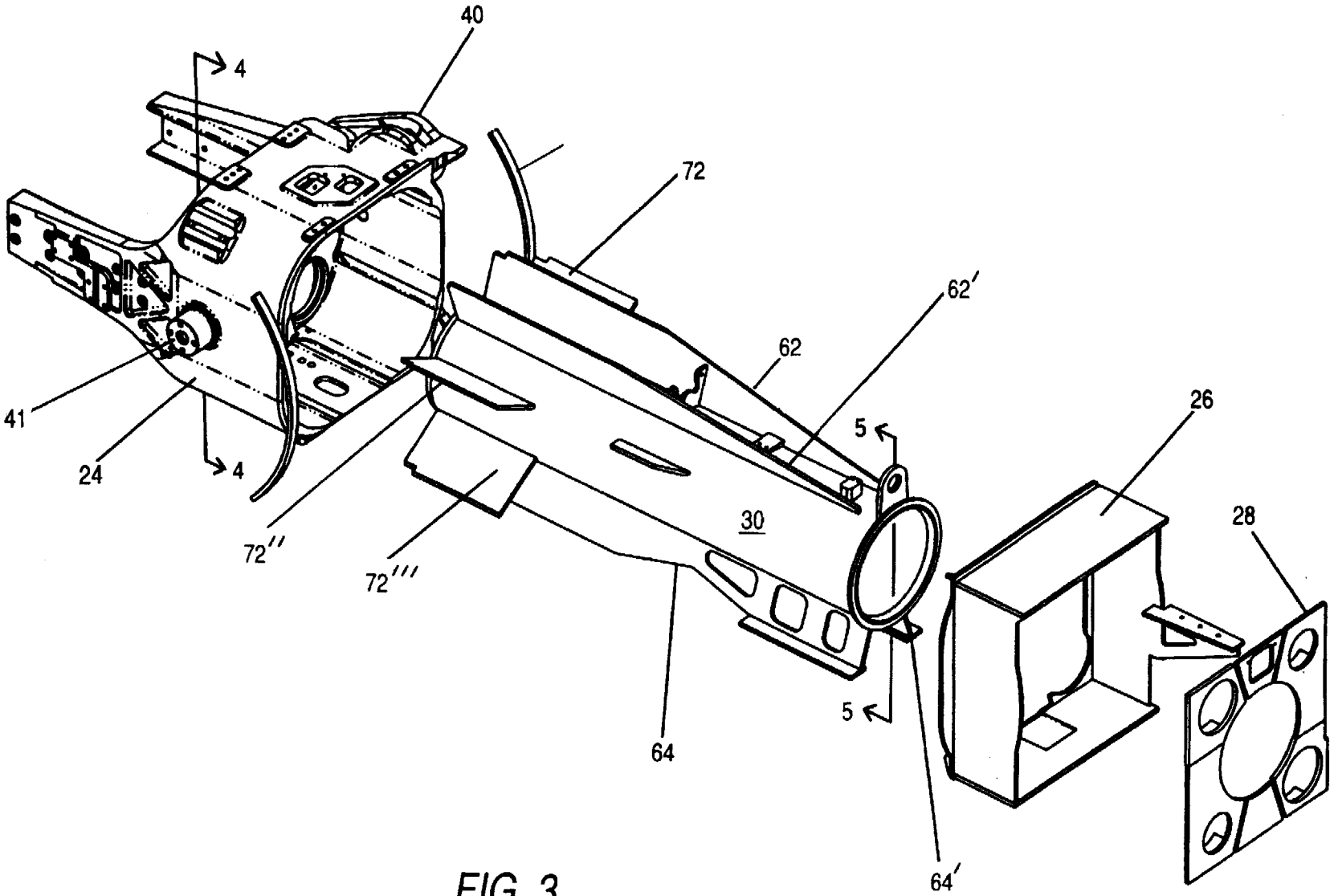
FIG. 3 is an exploded view of a cradle assembly.
Figure 4:
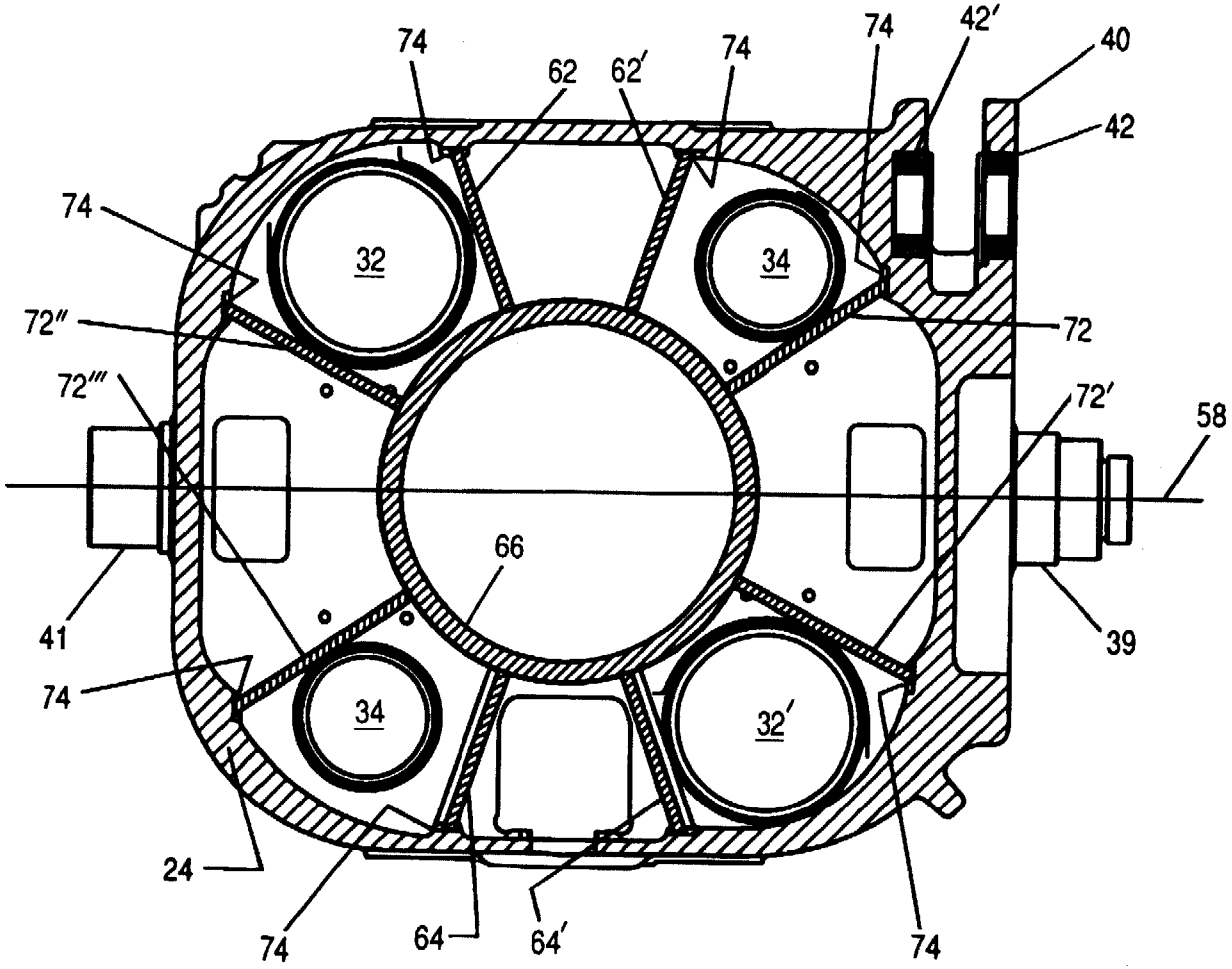
FIG. 4 is a cross-sectional view of the cradle assembly taken along line 4—4 of FIG. 3.

Referring now to FIGS. 3 and 4, the gun mount main support structure is primarily comprised of cradle casting 24, a gusseted tube assembly 30, adapter weldment 26 and bulkhead 28. This structure when welded together houses and provides the mechanical means to support the gun tube assembly 16 upon elevation and firing. This main structure also provides an interface for the recoil and recuperator system module components 32, 32' and 34, 34' respectively which attach to both the machined cradle assembly of FIG. 3 and the gun tube assembly 16 via the breech ring assembly 10. The cradle casting 24 permits rotary elevation of the gun mount about horizontal axis 58 established by trunnions 39 and 41. Bushings 42, 42' are installed into the lifting lug 40 of the cradle casting 24 to provide a durable, replaceable interface for the gun mount elevation actuator, not shown. A cradle casting pilot diameter serves as a locational guide to fixture the installation and subsequent welding of the gusseted tube assembly 30 to the cradle casting 24.

Referring to FIGS. 3, 4 and 5, two top flanges 62, 62' and two bottom flanges 64, 64' are welded to support tube 66 and are the primary structural support of the gusseted tube assembly 30 under static cannon weight loading and dynamic firing loads. Upper rib tie 68 and lower rib tie 70 are welded between the top flanges 62, 62' and 64, 64' respectively to provide lateral support. Four gusset tube side flanges 72, 72', 72", and 72'" are also welded to the support tube 66 providing additional side support structure within cradle casting 24, and in conjunction with both the top flanges 62, 62' and the bottom flanges 64, 64', are welded to machine pads 74 of cradle casting 24. The adapter weldment 26 is also welded to the cradle casting 24, top flanges 62, 62' and bottom flanges 64, 64'. Front bulkhead assembly 28, when welded together with both the adapter weldment 26 and support tube 66, provides radial support for the components of the recoil system. Adapter weldment 26 also forms the interface and support structure for the ballistic shield 14 components, the rotor shield 69, and radar bracket 36.

Figure 6:
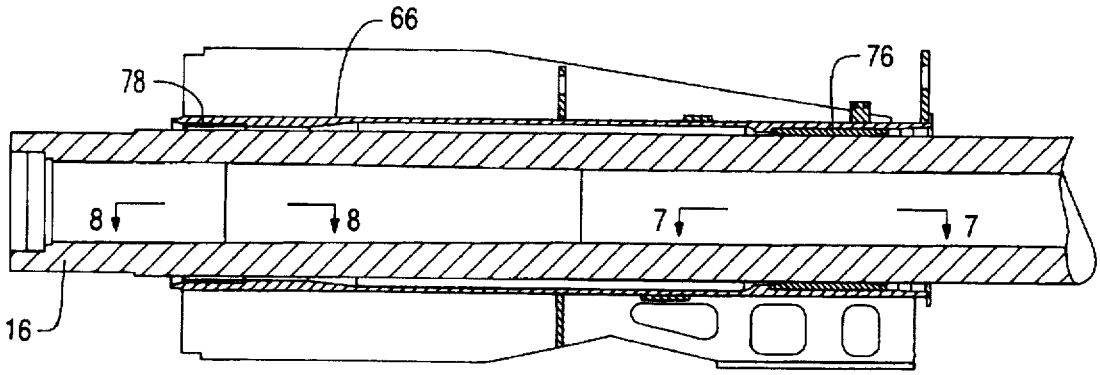
FIG. 6 is a diametrical cross-sectional view of a gusseted tube assembly, gun tube bearings, and a partial cross-section of the gun tube.
Figure 7:
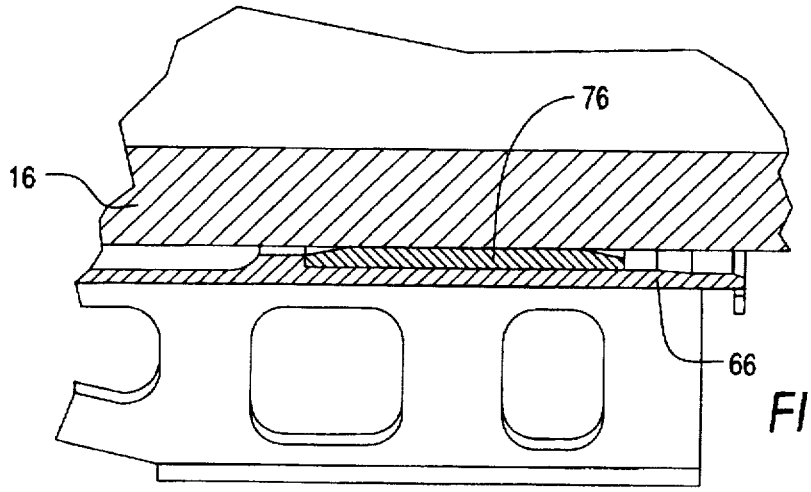
FIG. 7 is an enlarged detailed view of a front gun tube bearing taken between lines 7—7 of FIG. 8.

Referring now to FIG. 6 and 7 gusseted tube assembly 30 supports a press fit forward gun tube bearing 76 and an aft gun tube bearing 78. Forward gun tube bearing 76 provides radial support and facilitates translation of the gun tube assembly 16 during recoil and counter recoil.

Figure 8:
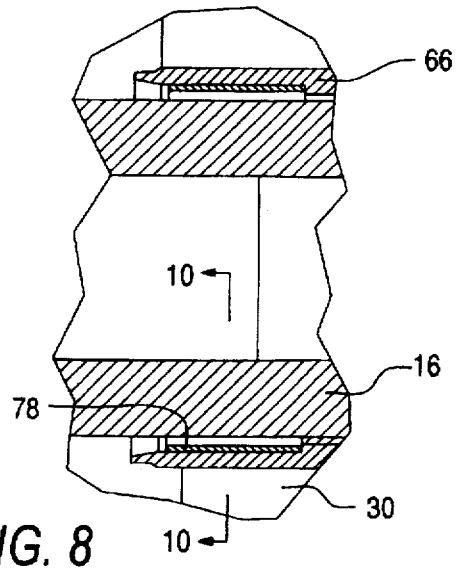
FIG. 8 is an enlarged detailed partial view of a rear gun tube bearing between lines 8—8 of FIG. 6.
Figure 9:
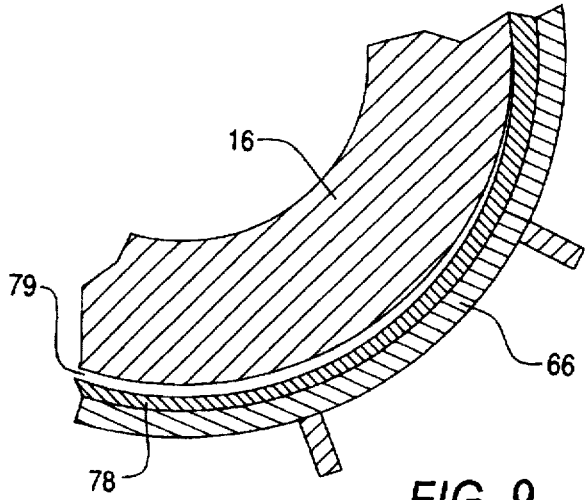
FIG. 9 is an enlarged detailed partial view half-way through the rear gun tube bearing taken along lines 10—10 of FIG. 8.

Referring now to FIGS. 8 and 9, aft tube bearing 78 constrains and supports the gun tube assembly 16 in the horizontal direction only. Aft tube bearing 78 is machined such that clearance space 79 is provided in the vertical direction. Control in the horizontal direction is provided by both the forward tube bearing 76 and the aft tube bearing 78. The rail bearings 48, 48' and way bearings 46, 46', in conjunction with the forward tube bearing 76 complete a three point mounting system of the gun tube assembly 16 and provide both control and support.

Referring to FIGS. 2, 10, 11 and 12, two rails 48 and 48' are positioned symmetrically on either side of the breech assembly 10. The rails 48, 48', only the former being depicted, are fixedly attached to the breech assembly 10 with threaded fasteners 80. Each way bearing 46 is positioned completely into the cradle way pockets 44 of the cradle casting 24. The forward face 47 of way channel bearing 46 is positioned against the way pocket inside channel face 49 and fixedly held thereto with fasteners 80.

Referring again to FIG. 10, in operation the rail tight tolerance torque surfaces 82, located on each rail 48 and the way tight tolerance torque surfaces 84 located on each way bearing 46 are designed to react to the static gun tube assembly 16 weight loads and the dynamic rifling torque-induced bearing loads at the onset of firing. The rail 48 tight tolerance torque surfaces 82 are located as far forward as possible to efficiently transfer load through the cradle casting 24 into the trunnions 39 and 41. Clearance in the torque surface regions is held to a minimum to maximize alignment accuracy and reduce the possibility of impact loading between the rail 48 and the way bearing 46. Rail and way tapered surfaces 86, 87 respectively facilitate the transition from the tight tolerance rail and way torque surfaces 82 and 84 respectively to the rail and way secondary sliding surfaces 88 and 90 on the rail 48 and way bearing 46 respectively, as the gun tube assembly 16 recoils to where rifling torque-induced bearing loads subside. The secondary sliding surfaces 88 and 90 on both the rails 48 and the way bearing 46, respectively, provide a greater degree of clearance along the bulk of their length to minimize the possibility of binding and bearing friction as the gun tube assembly 16 translates in and out of the battery position. At full recoil, gun tube assembly 16 is cantilevered from the rails 48 as shown in FIG. 2. As the gun tube assembly 16 returns to battery, the contact between the rail 48 and the way bearing 46 transfers from the secondary sliding surfaces 88 and 90 back to the tight tolerance bearing surfaces 82 and 84 in preparation for reloading and additional firing.

Figure 13:
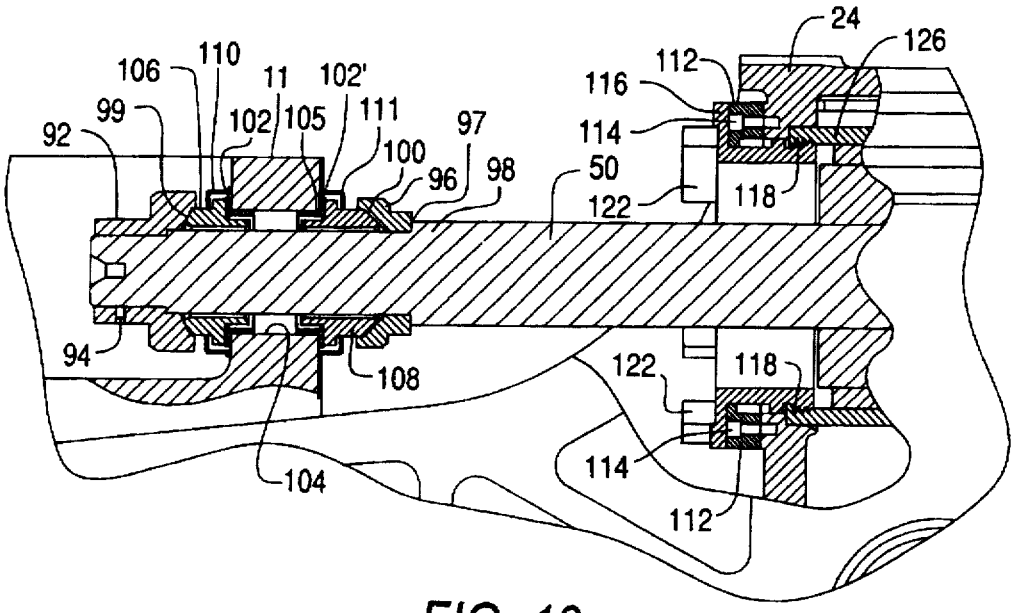
FIG. 13 is a partial diametrical cross-sectional view taken along line 13—13 of FIG. 2 showing the universal coupler attachment to one of the two recoil rods and a partial cross-section of the recoil module attachment system.

Referring now to FIGS. 2 and 13, the attachment of recoil mechanism rods 50, 50' and recuperator mechanism rods 52, 52' to breech flange 11 is accomplished by means of universal coupler attachments. The recuperator mechanism rod attachment is similar with slight modification and will be discussed herein after. This attachment method in FIG. 13, in enlarged cross-section, accommodates any relative deflections or misalignments between the gun mount structure, the recoil and/or recuperator mechanisms 32, 32' and 34, 34' and cannon assembly 16, respectively, due to firing forces and/or due to manufacturing tolerances of the universal coupler interface components. In addition, this method of attachment limits the potential for undesirable radial loading of the recoil rods 50, 50' and recuperator rods 52, 52', which could cause seal damage and subsequent leakage from the recoil modules 32, 32' and the recuperator modules 34, 34'. Outer coupler pivot nut 92 is threadedly affixed to recoil mechanism rod 50 and prevented from inadvertently loosening therefrom by set screw 94. A second inner pivot nut 96 is also threadedly attached to recoil rod 50. An annular shim 97 is operatively positioned intermediate inner pivot nut 96 and recoil rod shoulder 98. Shim 97 positions inner pivot nut 96 such that the outer and inner ball socket faces 99 and 100 respectively occupy a single spherical surface. A pair of outer and inner thrust bushings 102 and 102' respectively are located on both sides of breech flange bore 104. Outer and inner ball members 106, 108 are axially positioned by thrust bushings 102 and 102' respectively, and by an annular shim 105, which is positioned by the intermediate breech flange 11 and inner thrust bushing 102', so that the spherical faces of outer and inner ball members 106 and 108 occupy the same spherical surface and are in contact with outer and inner ball socket faces 99 and 100 respectively. Outer and inner balls 106, 108 are radially located strictly by pivot nuts 92 and 96 respectively. A radial clearance exists between outer and inner balls 106, 108 respectively and between thrust bushings 102 and 102' respectively for the purpose of accommodating manufacturing tolerances and potential misalignments induced during firing of gun mount assembly. Coupler retainers 110, 111 are affixed to each side of the mounting breech flange 11 with threaded fasteners, not shown on FIG. 13. Coupler retainers 110 and 111 alleviate the necessity to remove balls 106 and 108, flange thrust bushings 102 and 102' and shim 105 during recoil mechanism removal and replacement. Adequate radial clearance is provided between retainers 110, 111 and ball members 106 and 108 to accommodate clearance. For universal coupler attachment to recuperator module rod 52, the coupling scheme is similar in design to that afore described, except that shims 97 and 105, pivot nut 96, inner ball member 108 and their corresponding coupler retainer 111 and thrust bushing 102', are not required and thus are not present. Attachment of the recoil modules 32, 32' and recuperator modules 34, 34' to the gun mount cradle casting 24 is accomplished by means of captured retainer components. This attachment method allows for recoil and recuperator removal without producing loose components in the process, thereby reducing time required for and ease of maintenance. Split retention plates 112 are secured to gun mount cradle casting 24 by means of threaded fasteners 114. Module retainer member 116 is nested within split retention plates 112. The threaded fasteners 114 are installed by aligning threaded access holes on module retainer 116 with mounting holes on split retention plates 112. Due to shoulder features on split retention plates 112 and module retainer 116, module retainer 116 is attached to gun mount cradle casting 24. A male threaded feature 118 on module retainer 116 interfaces with an internally threaded recoil module case 120. The cases of recuperator modules 34 and 34' are held to their module retainers, not shown, in a similar fashion. Protrusions 122 on recoil module retainer permit the recoil case 120 to be threadedly affixed to retainer 116. Once the recoil and recuperator mechanisms are secured to cradle casting 24, retainer 116 is secured in position by means of set screws, not shown in FIG. 13.

Figure 14:
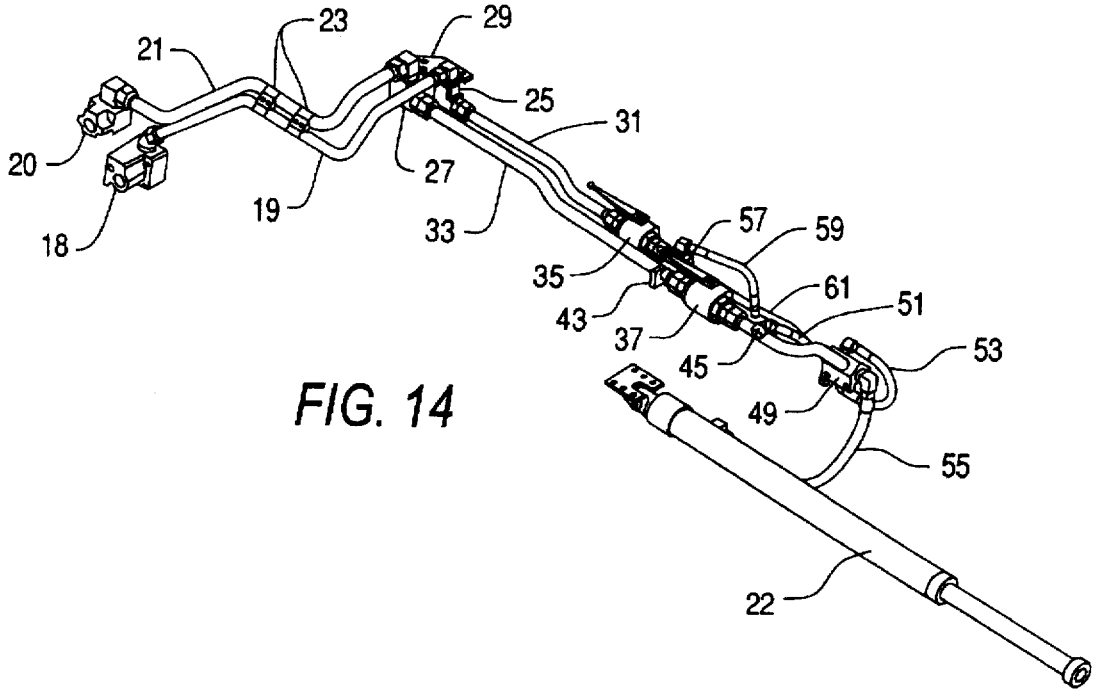
FIG. 14 is an isometric view of the coolant line and valve components partially shown in FIG. 1.

Referring now to FIGS. 1, 4, and 14, an integral closed-loop gun mount cooling system provides a cooling agent to remove heat from recoil modules 32, 32' and gun tube 17. Supply manifold 18 and return manifold 20 are operatively mounted to cradle casting 24 with threaded fasteners. Manifolds 18 and 20' provide the transport vehicle interface hose attachment connections to the heat exchanger system (not shown). Tubing 19 and 21 are routed along the contours of cradle casting 24, and are secured thereto with mounting clamps 23 which are in turn secured to the casting 24 by threaded fasteners, not shown. Supply manifold 25 and return manifold 27 are also secured to casting 24 with threaded fasteners, not shown. Supply manifold 25 and return manifold 27 are connected to and are attached to cradle casting 24 with bracket 29 allowing the cooling plumbing to be diverted through cradle casting 24 into the cavity of gun mount ballistic shield 12. Supply coolant tubing 31 and return tubing 33 are operatively positioned and fluidly connected intermediate in line supply and valves 35 and 37 respectively. The function of valves 35 and 37 is to isolate the main section of the gun mount cooling system during recoil module 32 or 32' replacement, in order to minimize coolant leakage. Return ball valve 37 is rigidly secured to the gusseted tube assembly 30 by brackets 43 and 45. Bracket 45 also serves to secure a return manifold 49 which provides coolant connection to return hoses 51, 53 and 55. Return hoses 51 and 53 are routed to recoil modules 32 and 32' to provide a return line for recoil module coolant while return hose 55 is routed from telescoping tube assembly 22 to provide a return line for gun tube 17. Supply ball valve 35 is fluidly connected to supply manifold 57 which in turn is fluidly connected to supply hoses 59 and 61 which supply coolant for recoil modules 32 and 32' respectively.

Figure 15:
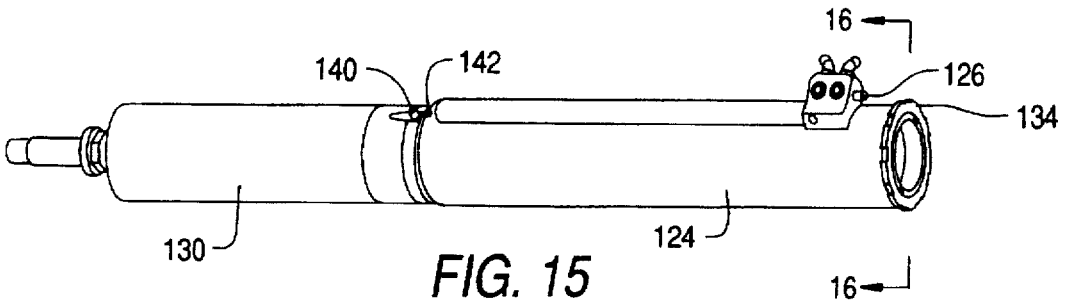
FIG. 15 is an isometric view of a recoil module.
Figure 16:
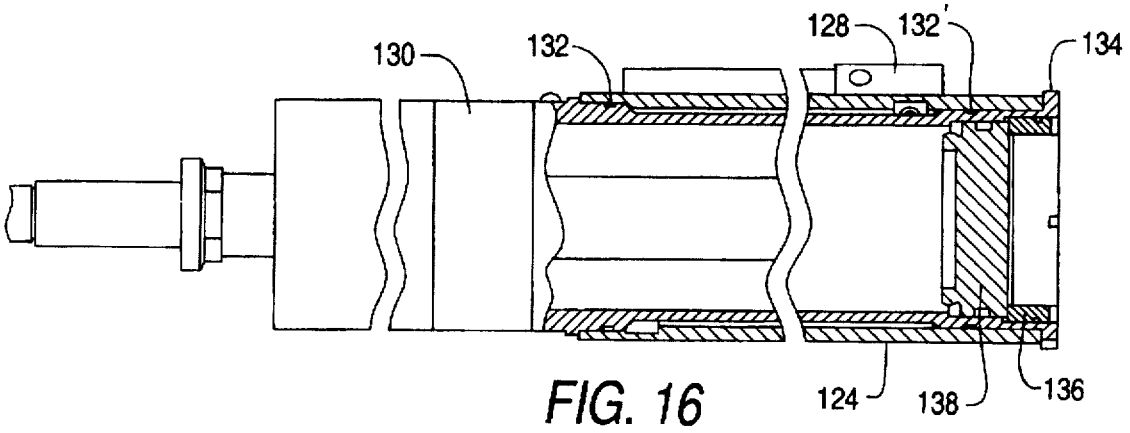
FIG. 16 is a partial cross-sectional view of the recoil module cooling system taken along line 16—16 of FIG. 15.

Referring now to FIGS. 15 and 16, recoil modules 32, 32' utilize a cooling jacket 124. A bleeder valve 126 is operatively positioned on jacket manifold 128 to allow air to be purged from the cooling system for maximum heat removal efficiency. The cooling jacket 124 is sealed to the recoil case 130 with O-rings 132, 132'. The difference between the inner diameter of jacket 124 and outer diameter of case 130 creates an annulus surrounding recoil case 130 enabling a flow of coolant therewithin. The cooling jacket 124 on its forward end is axially secured by a retaining collar 134, which is threadedly affixed to a recoil head retainer 136. Recoil head retainer 136 is in turn threaded to module case 130, and serves to axially retain replenisher head 138. The cooling jacket 124 is radially retained by bolt 140 which is threadedly affixed to recoil module case 130. Cooling jacket 124 is radially oriented so that bolt 140 rests within a slot 142 located on the rear end of cooling jacket 124.

Figure 18:
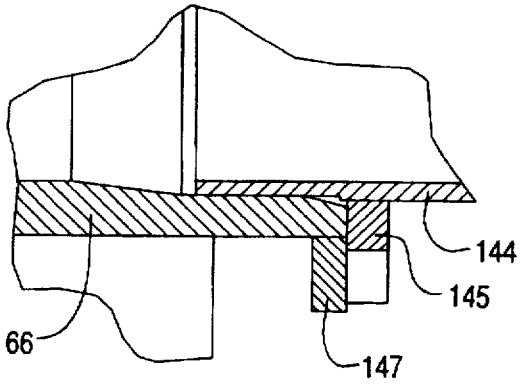
FIG. 18 is an enlarged partial cross-sectional view taken along line 18—18 of FIG. 1 of the rear end of the dust can assembly.

Referring now to FIGS. 1 and 18, a flanged cylindrical shaped dust shield 144 is fixedly attached at its aft flange 145 to the flange front end 147 of gusset tube 66 with threaded fasteners.

Figure 17:
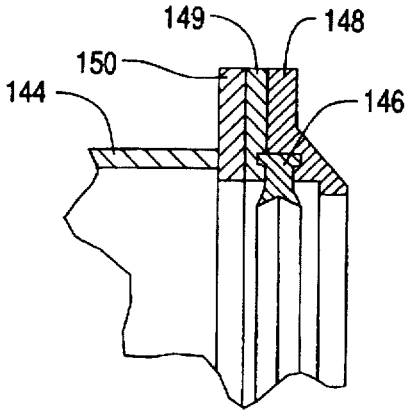
FIG. 17 is an enlarged partial cross-sectional view of the forward end of the dust can assembly taken along line 17—17 of FIG. 1.

Referring to FIGS. 1 and 17, a wiper seal 146 is assembled to the forward end of dust shield 144 by capturing the wiper seal 146 within a gland formed by axially mating seal flange 148 and annular seal spacer 149. This subassembly is fixedly attached to the dust shield forward flange 150 with fasteners. Clearance is provided in the mounting holes located on the aft and forward flanges 145 and 150 respectively allowing for axial adjustment of wiper seal 146 and seal flange 148 to account for tolerance variations and deflection of the gun tube 17. Wiper seal 146 contains a scarf cut to facilitate replacement in the field without disassembly of the gun tube 17.

Figure 19:
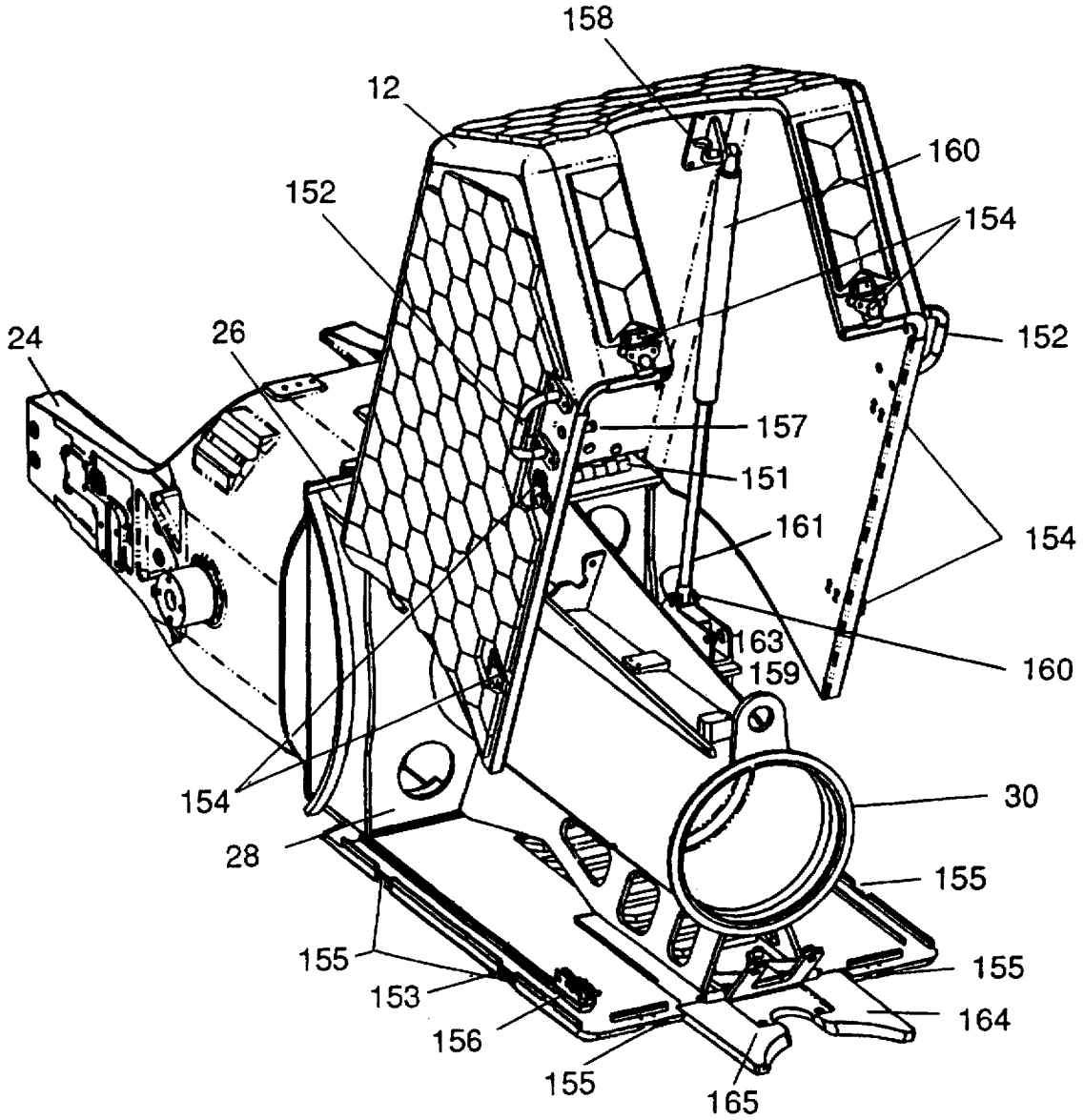
FIG. 19 is an isometric view of the gun mount with the ballistic shield open. Other gun mount elements have been deleted to better show the ballistic shield and its related components.

Referring to FIG. 19 ballistic shield 12 is operatively attached to gun mount adapter weldment 26 by hinge 151. Hinge 151 allows the shield 12 to be rotated upward to provide access for servicing components contained therein. Shield handles 152, 152' facilitate lifting and closing. A lower ballistic shield plate 153, fixedly attached to the adapter 26 and front bulkhead weldment 28 and to the gusseted tube assembly 30, supports shield 12 when it is in the closed position shown in FIG. 2. Shield 12 is retained in its closed position by draw latches 154 which are fixedly attached thereto and latch keepers 155 fixedly attached to shield plate 153. A rotary latch 156 attached to plate 153 and a sticker pin 157 threadedly attached to shield 12 retain shield 12 temporarily in a closed position to allow closure of draw latches 154, and provides secondary shield retention. A multiplicity of applique armor tiles 14 are secured by hook and loop material which is adhesively attached to shield 12. An upper shield support bracket 158 is attached to the inside surface of shield 12, and a lower bracket 159, attached to front bulkhead 28, supports a gas strut 160 which reduces the force necessary to open and close shield 12. Gas strut 160 is fitted with a schrader valve, not shown, to adjust the internal pressure for weight and temperature variations. The pin and clevis attachment point of gas strut 160 to lower bracket 159 can be adjusted by relocating strut pin 161 to the aft bracket position 163 for providing adequate lifting force for shield 12 when the applique armor 14 is removed. A hinged armor plate assembly 164 is rotatably attached to lower shield plate 153, and held in a fixed upright closed position by captive fasteners.

While a specific embodiment of the invention has been shown and described in detail to illustrate the application of the principles of the invention, it will be understood that the invention may be embodied otherwise without departing from such principles.

What is claimed is:

1. A gun mount system for firing long range projectiles from a gun tube under rapid fire conditions which comprises:

cradle casting means for supporting and elevating said gun tube during aiming and recoil positions;

gusseted tube assembly means for operatively supporting said gun tube, and for enabling replacement of said gun tube under field conditions;

breech block means into which is placed said gun tube during recoil and counter-recoil positions;

recoil means in said gun mount system to further assist said gun mount system to withstand rapid fire conditions;

recuperator means for controlling position of said breech block means after recoil;

coolant means for providing an integral liquid coolant to said recoil means and said gun tube;

rotor shield means for protecting said gun mount system;

ballistic shield cover means for further providing protection for said gun mount system; and dust shield means for preventing particulate contamination of said gun tube.

2. A gun mount system as recited in claim 1 wherein said cradle casting means includes:

a machined cradle casting having a pair of oppositely disposed way pockets operatively located therein;

a way bearing member fixedly attached to each of said way pockets;

a cradle casting pilot bore into which is inserted said gusseted tube assembly;

a pair of oppositely disposed trunnions operatively positioned on said cradle casting in front of said way pockets for permitting elevation of said gun tube;

coolant supply manifold fixedly attached to said cradle casting;

coolant return manifold fixedly attached to said cradle casting;

lug means for elevating said cradle casting; and a plurality of machined pads operatively disposed on the inside surface of said cradle casting for supporting said gusseted tube assembly means therein.

3. A gun mount system as recited in claim 2 wherein said gusseted tube assembly means includes:

a cylindrically shaped gusset support tube;

a pair of top flange members welded to said gusset support tube and said cradle machined pads;

a pair of bottom flange members welded to said gusset support tube and said cradle machined pads;

four side flange members welded to said gusset support tube and said cradle machined pads;

a box shaped adapter member welded to said cradle casting and said rotor shield; and a front bulkhead member welded to said adapter member.

4. A gun mount system as recited in claim 3 wherein said gusset support tube includes:

a press fit forward gun tube bearing operatively located in a front end counter bore of said gusset support tube, providing radial support and facilitating translation of said gun tube during recoil and counter recoil; and a press fit aft gun tube bearing operatively located in a rear counterbore of said gusset support tube for facilitating translation of said gun tube during recoil and counter recoil.

5. A gun mount system as recited in claim 4 wherein said aft gun tube bearing includes a machined aft bearing means for constraining and supporting said gun tube assembly in a horizontal direction only.

6. A gun mount system as recited in claim 5 wherein said breech block means includes:

a pair of breech guide rails in said breech block means each of said rails in horizontal and vertical alignment with and in sliding contact with each of said cradle casting way bearing members.

7. A gun mount system as recited in claim 6 wherein each of said guide rails and said way bearing members include rail and way bearing tight tolerance torque surfaces, operatively positioned to react to static gun tube weight loading and dynamic rifling torque-induced bearing loads at the onset of firing.

8. A gun mount system as recited in claim 7 wherein said guide rails and said way bearing members include:

rail and way bearing tapered surfaces operatively positioned thereon; and rail and way bearing secondary sliding surfaces operatively positioned to facilitate the transition from said tight tolerance rail and way torque surfaces to said rail and way secondary sliding surfaces as said gun tube recoils to where rifling torque-induced bearing loads subside.

9. A gun mount system as recited in claim 8 wherein said recoil means includes:

a recoil module having a cylindrical shaped water cooling jacket;

a jacket manifold positioned on said water jacket and fluidly connected to said coolant means;

a bleeder valve connected to said jacket manifold for allowing air to be purged from said coolant means for maximum heat dissipation;

a recoil case inside of said cooling jacket forming an annular space therebetween and allowing a flow of coolant therewithin;

a pair of O-rings for sealing said cooling jacket to said recoil case;

a retaining collar for securing said cooling jacket, located on a forward end of said cooling jacket;

a recoil head retainer threadedly affixed to said retaining collar and to said recoil case; and a replenisher head slidably disposed in said recoil case and axially retained by said recoil head retainer.

10. A gun mount system as recited in claim 9 wherein said recoil module includes:

a recoil mechanism rod placed inside said breech block means by a universal coupler means for accommodating any relative deflections or misalignments between said gun tube and said recoil means and said recuperator means due to firing forces and/or due to manufacturing tolerance variations of said universal coupler means.

11. A gun mount system as recited in claim 10 wherein said rotor shield means includes:

a formed radius titanium armor plate fixedly welded to said cradle casting and said adapter member.

12. A gun mount system as recited in claim 11 wherein said ballistic shield cover means includes:

a shield cover hingedly attached to said adapter member;

a lower ballistic shield plate welded to said adapter member;

a plurality of replaceable applique armor tiles applied to said shield cover;

gas strut means operatively connected to said shield cover for reducing the force necessary to open and close said shield cover;

a plurality of draw latches fixedly attached to said shield cover; and a plurality of keepers fixedly attached to said lower shield plate and in-line with said draw latches, said latches and keepers when locked together prevent said shield cover from inadvertently opening up when said gun mount system is in a firing mode.

13. A gun mount system as recited in claim 12 wherein said dust shield means includes:

a flanged cylindrically shaped dust shield having a flange aft end fixedly attached to a front flange of said gusset support tube, and a forward dust shield flange end;

an annular seal spacer axially positioned in alignment with said dust shield cylinder;

a front seal flange fixedly positioned in abutment and axial alignment with said seal spacer, said seal spacer and said front seal flange forming a gland space therebetween; and a wiper seal operatively captured in said gland space permits said gun tube to slide therethrough during recoil and counter recoil positions.

* * * * *